340-554 SR
3/9/82 XR 4,319,228

United States Patent [19]

Daniels

[11] 4,319,228

[45] Mar. 9, 1982

[54] PORTABLE INTRUSION ALARM

[76] Inventor: Edward H. Daniels, 1961 Delaware, Gary, Ind. 46407

[21] Appl. No.: 154,069

[22] Filed: May 28, 1980

Related U.S. Application Data

[63] Continuation of Ser. No. 971,506, Dec. 20, 1978, abandoned.

[51] Int. Cl.[3] ..... G08B 13/00; G08B 13/08; G08B 13/18

[52] U.S. Cl. ..... 340/521; 340/546; 340/547; 340/554; 340/693

[58] Field of Search ..... 340/546, 521, 547, 554, 340/693

[56] References Cited

U.S. PATENT DOCUMENTS

| | | | |
|---|---|---|---|
| 2,670,466 | 2/1954 | Harper | 340/546 |
| 2,851,680 | 9/1958 | Cavera | 340/546 |
| 3,439,357 | 4/1969 | De Gibaja | 340/521 |
| 3,540,043 | 11/1970 | Crosthwait | 340/521 |
| 3,634,846 | 1/1972 | Fogiel | 340/521 |
| 3,680,074 | 7/1972 | Lieser | 340/554 |
| 3,691,558 | 9/1972 | Hoard et al. | 340/554 |
| 3,746,878 | 7/1973 | Viger, Jr. | 340/693 |
| 3,908,180 | 9/1975 | Braginsky | 340/521 |
| 3,924,254 | 12/1975 | Klebold et al. | 340/566 |

*Primary Examiner*—Glen R. Swann, III
*Attorney, Agent, or Firm*—McDougall, Hersh & Scott

[57] ABSTRACT

An intrusion alarm is provided in a compact enclosure permitting its movement from location to location as needed. The alarm includes one or more motion detectors, some of which may be battery operated, one or more alarm devices, such as horns, sirens, etc., door switches and appropriate relays for operating the system. A battery back up system insures that the alarm is always activated.

6 Claims, 2 Drawing Figures

PORTABLE INTRUSION ALARM

This is a continuation of application Ser. No. 971,506, filed Dec. 20, 1978, now abandoned.

BACKGROUND OF THE INVENTION

This invention relates to the field of burglar or intrusion alarm systems. More specifically, it relates to intrusion alarms which are portable and easily moved from location to location.

Most intrusion alarm systems are permanent installations and involve door and window switches, pressure switches in the floor, photoelectric cells and the like. These detecting devices are connected to a central alarm box by wires permanently installed in the walls, floor and ceiling of the area to be protected. Such alarm systems, while satisfactory for normal installations as, for example, home or store, have certain drawbacks in that they cannot be easily moved to other locations when the need arises.

Protecting various locations within a school is a typical situation where conventional alarm systems are not satisfactory. Depending upon the time of year, i.e., school is in session or on vacation, the use pattern of the school building will change. Likewise, different areas of the school require protection depending upon the equipment currently maintained therein as, for example, the band room, the typing room, the machine shop, the boiler room. For installations such as a school, hospital or other location where alarm flexibility is desired a portable unit is a more satisfactory solution to the problem of providing protection against burglary or unauthorized entry.

Portable alarms are known. See, for example, the references disclosed in the prior art statement which follows. The prior portable alarms, however, have not been entirely satisfactory in that they do not permit adequate surveillance of the room to be secured, or do not provide back up power in the event of a power failure in the building in which the alarm system is installed. Additionally, many are limited in flexibility as to the type of detectors and alarm devices which they can accommodate.

It is accordingly an object of the present invention to provide a portable intrusion alarm system which can be easily moved to a desired location and rapidly installed.

A further object of the invention is to provide a portable alarm system which includes means for insuring continuous protection even in the absence of power in the area to be protected.

A further object of the invention is to provide a portable alarm system capable of accommodating a plurality of alarm and detection devices so that the system may be tailored to a given application.

Other objects and advantages of the invention will be apparent from the remaining portion of the specification.

PRIOR ART STATEMENT

In accordance with the provisions of 37 CFR §1.97, applicant states that the closest prior art of which he is aware are the following U.S. Pat. Nos. 2,851,680 to Cavera and 3,924,254 to Klebold et al.

Cavera discloses a portable burglar alarm which fires cartridges, lights a lamp and turns on a buzzer in response to operation of a reed switch. Portions of the circuit may be battery operated. Klebold et al discloses an intrusion alarm employing a motion detector in a compact housing.

In addition to these references, the following U.S. Pat. Nos. were developed by a prior art search: 2,866,181; 2,912,540; 2,972,133; 3,165,727; 3,383,674; 3,406,385; 3,439,357; and 3,766,537.

DETAILED DESCRIPTION

Figure 1:
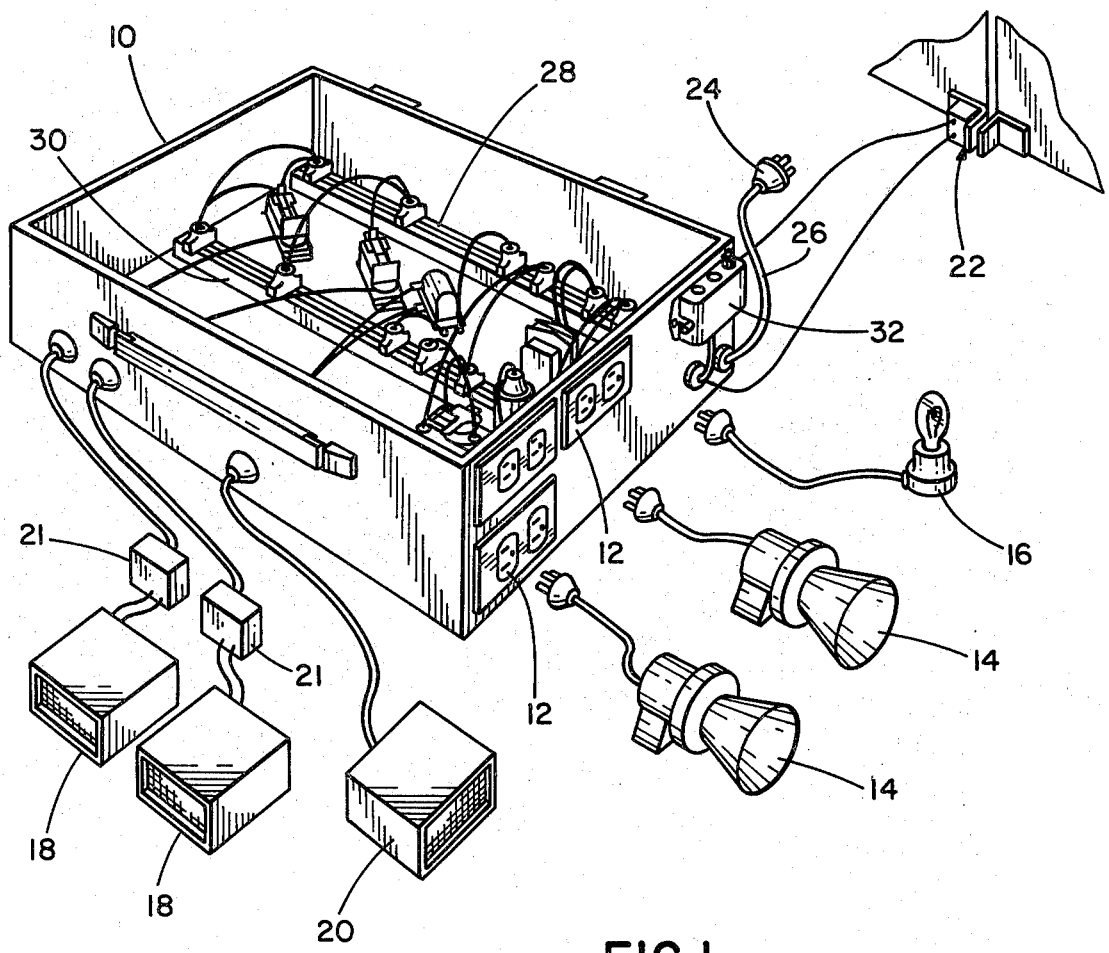
FIG. 1 is a perspective view of the hardware employed in the present invention illustrating the manner of connecting the elements of the system within a room to be protected.

Referring now to FIG. 1, an intrusion alarm system according to the invention is illustrated. The alarm system includes an enclosure 10 in which the principal components, such as relays, transformers and connecting wires, are housed. The top of the enclosure has been removed for clarity. A plurality of conventional electrical outlet receptacles 12 are provided on one side of the enclosure for connecting various alarm devices, such as horns 14, lights 16, or other devices. Specifically, telephone dialers, transmitters or other devices can be connected to the system by means of the receptacles 12.

The inputs to the detection system are provided from motion detectors 18 and 20 and from a magnetic door switch 22. In the FIG. 1 embodiment two AC operated motion detectors 18 are employed in conjunction with a single battery operated motion detector 20. Of course, other options can be employed depending upon the configuration of the room to be protected.

Figure 2:
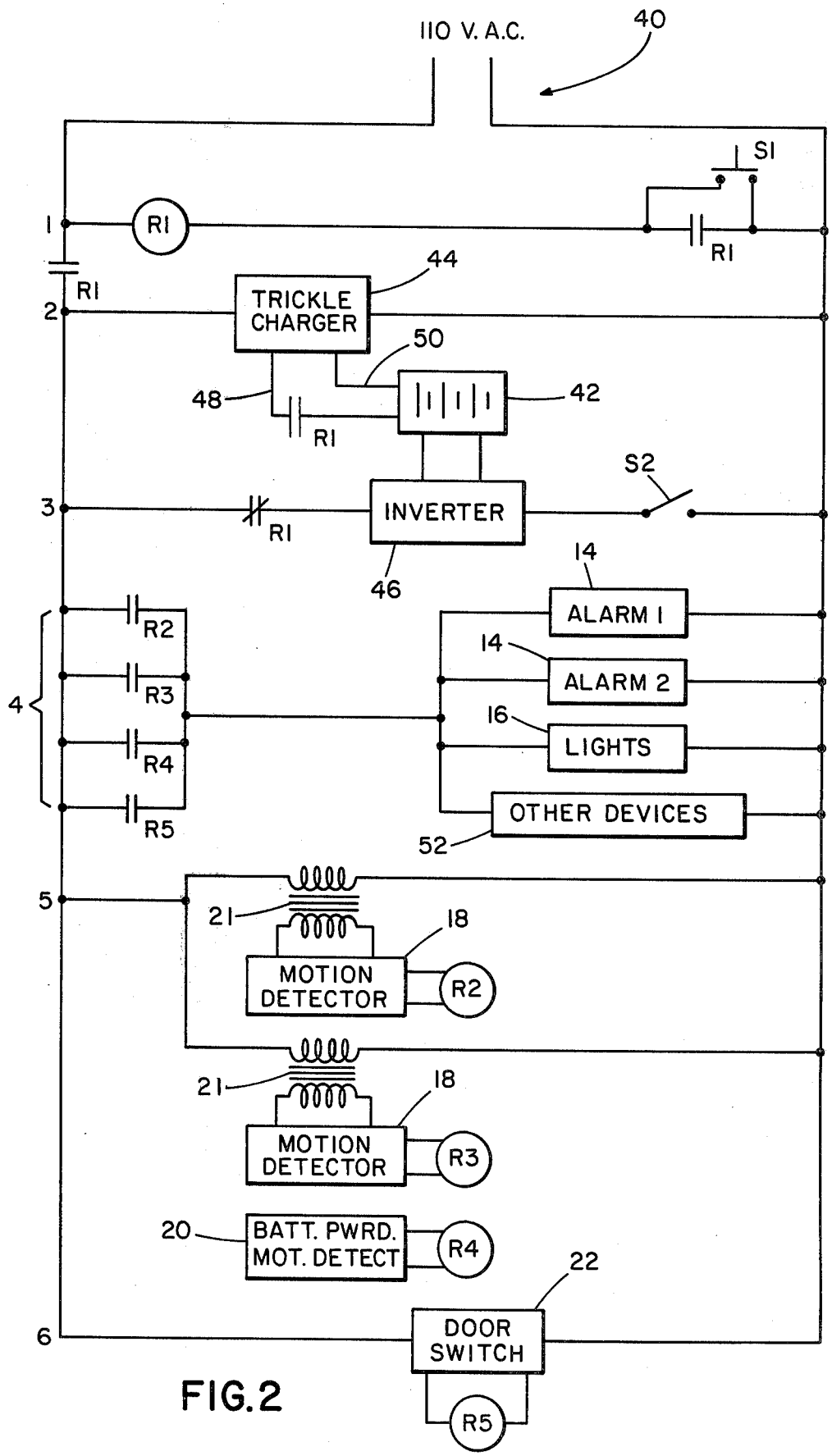
FIG. 2 is a schematic diagram of the electrical circuit employed in the present invention.

The AC operated motion detectors employ transformers 21 to step down the line voltage to a suitable value. Battery operated motion detector 20 includes a battery supply within its housing and is powered independently of the line voltage. The line voltage for the system is obtained from plug 24 attached to line 26 which supplies power buses 28 and 30 mounted within the housing 10. The various relays shown in the schematic of FIG. 2 are secured within the housing 10 adjacent the power buses 28 and 30 as space permits. The relay designated R5 in FIG. 2 associated with the door switch 22 is mounted externally of the box 10 at 32.

Referring now to FIG. 2, an electrical schematic of the invention is illustrated. An AC power bus is designated 40 and the various relays and devices are connected to the bus in the manner indicated. The schematic illustrates five relays for operating the system but it will be apparent that a greater or lesser number of relays would be involved depending upon the number of intrusion detection devices employed.

In order to insure continuous operation of the system in the event of a power failure, a battery 42 is included in the circuit. During normal operation the battery is maintained at full charge by a trickle charge device 44 of a commercially available type. In the event of a power failure, the battery 42 provides power for operating the system by means of a DC to AC inverter 46 connected to the battery and to the line in a manner to be described.

For ease of discussion, the various lines of the circuit have been numbered at the left hand portion of the figure. Referring to lines 1, 2 and 3 of the circuit, the normal and standby power systems are illustrated and will now be described. Line 1 includes relay R1 and a set of normally open contacts associated therewith. Bridging the R1 contacts is a push button switch S1 which serves to arm the system when it has been installed in a desired location. Line 2 has the trickle charger 44 connected thereacross which, in turn, is electrically connected to the battery 42 by conductors 48 and 50. Conductor 48 is interrupted by a pair of normally open contacts associated with the relay R1.

A third set of normally open R1 contacts are placed in the AC power bus between line 1 and 2 while line 3 has a fourth set of R1 contacts, this set being normally closed and in series with the inverter 46. A switch S2, in series with the inverter on line 3 completes the power supply portion of the inverter.

The circuit as thus described normally provides 110 volts AC to lines 4 to 6 of the circuit. In the event of a power failure, the battery 42 is switched onto the power bus and by means of the inverter 46 to provide sufficient AC voltage to operate the system for a considerable period of time. To prevent damage to the inverter or trickle charger in the event power should be restored after a failure, the circuit remains in the battery mode until manually reset by operation of the switch S1.

Operation of lines 1 through 3 is as follows. When AC power is applied to the bus 40 relay R1 is not energized because of the open contacts on line 1. When it is desired to start the system the switch S2 is closed completing a circuit from the battery to the power bus through the inverter. In order to switch over to line voltage, switch S1 is momentarily depressed energizing relay R1. This closes the R1 contacts on line 1 maintaining relay 1 in the energized state. The trickle charger is then activated initiating charge of the battery 42 by virtue of the remaining two sets of normally open R1 contacts being closed. In turn, the inverter on line 3 is disconnected from the power bus by virtue of the normally closed R1 contacts opening.

Should the AC power fail after the system has been energized this will be detected by relay R1 causing a reversal of the four sets of R1 contacts associated therewith. The three normally open contacts will revert to their open state while the normally closed contact on line 3 will place the battery on the power bus via the inverter to supply current. Subsequent restoration of the line voltage does not affect the system unless the arming switch S1 is depressed to re-energize relay R1. As previously indicated, this prevents damage to the system in the event of a power failure.

Referring now to line 5, it will be ssen that the motion detectors 18 are connected in parallel across the power bus by means of the transformers 21. Each motion detector drives its own relay designated R2 and R3, respectively. These motion detectors are of a conventionally available type and they employ ultrasonic or sonar waves or similar radiation whereby movement in the protected area is detected and a voltage is produced for operating the associated relay. FIG. 2 shows the battery operated motion detector 20 positioned in the circuit between lines 5 and 6 and having associated therewith a relay R4. As previously indicated, this motion detector includes its own power supply in the form of a small battery which is periodically replaced. In all other respects it operates in the same way as detectors 18.

Finally, on line 6 the magnetic door switch 22 is schematically represented and is shown as operating a fifth relay R5. Should the door to which the switch is connected be opened the magnetic circuit created by the switch is interrupted activating the relay R5. Such switches are of a commercially available type and well known in the intrusion protection field. Preferably, door switch 22 is key operated to permit authorized entry and exit into the protected area without de-energizing the rest of the alarm system.

Referring to line 4, it will be seen that normally open contacts are provided for relays R2 through R5. These contacts are connected in parallel on line 4 to the alarm devices indicated. In FIG. 2 alarm devices 1 and 2 correspond to the horns 14 shown in FIG. 1, the "lights" block corresponds to the light 16 and block 52 is representative of other devices which may be connected to the system simply by being plugged into the receptacles 12. Such devices include phone dialers, recording systems, motor driven camera systems and additional alarm devices as required for a specific application.

From the preceding description of lines 4 through 6 the operation of the system should be apparent. Briefly, when anyone of the detection devices 18, 20 or 22 detects unauthorized intrusion, one or more relays are closed on line 4 tripping the various alarm devices connected in parallel thereto. Once the alarm has been tripped it will continue regardless of a power failure by virtue of the back up system provided by battery 42 and inverter 46. Motion detectors 18 and 20 will remain on as long as there is activity in the area. Once the area is clear they will, after a short delay, automatically reset, de-energizing their associated relays. To reset the system the alarm must be unplugged from the AC supply and the switch S2 opened to disable the battery. This provides a secure system not easily tampered with.

The system can be located out of sight to prevent tampering therewith and for added security the switches S1 and S2 can be secretly located within the enclosure and/or operated by means of a lock type switch to reduce the possibility of tampering with the system.

While I have shown and described embodiments of this invention in some detail, it will be understood that this description and illustrations are offered merely by way of example, and that the invention is to be limited in scope only by the appended claims.

I claim:

1. A portable intrusion alarm comprising:

an enclosure having an electrical bus contained therein for interconnecting various circuit components, a power line normally connected to the bus for supplying AC voltage to the bus in said enclosure, a DC storage battery, an inverter for producing AC from said battery, a power control relay for connecting said inverter to the electrical bus upon AC power line failure, means for initializing said power control relay to utilize power from the AC power line, motion detecting means connected to said bus and operating a first relay, magnetic door switch means connected to said bus and operating a second relay, a plurality of alarm devices located external to said enclosure but connected to one side of said bus, each of said first and second relays having a set of normally open contacts, said sets being connected in parallel with each other to the other side of said bus and, when energized, connecting the other side of the bus to said alarm devices, whereby any one of the first and second relays can energize the alarm devices by operation of its associated relay contacts.

2. The portable intrusion alarm according to claim 1 wherein said power controlled relay disconnects said power line from said bus simultaneously with connecting said inverter to the electrical bus upon AC power line failure.

3. The portable intrusion alarm according to claim 1 wherein said initializing means includes a manually operable switch and a pair of contacts of said power control relay, said manually operable switch is connected in parallel with said pair of contacts.

4. The portable intrusion alarm according to claim 3 wherein said manually operable switch is normally open and said pair of contacts is open when the power control relay is not energized, said manually operable switch and said pair of contacts being connected in series with the power control relay, whereby momentary closure of said manual switch energizes the power control relay causing said pair of contacts to close, thereby maintaining said relay energized when said manual switch is returned to the normally open position.

5. The portable intrusion alarm according to claim 1 wherein said power control relay includes a normally open second pair of contacts connected in series between one side of the AC power line and one side of said bus so as to apply AC voltage from the power line to the bus when closed.

6. The portable intrusion alarm according to claim 1 wherein said power control relay includes a normally closed third pair of contacts connected in series between said inverter and said bus to disconnect said inverter from said bus when AC voltage is available.

* * * * *